US011639213B2

(12) United States Patent
Ford

(10) Patent No.: US 11,639,213 B2
(45) Date of Patent: May 2, 2023

(54) FLOATATION DEVICE

(71) Applicant: Brent Adams Ford, Asheville, NC (US)

(72) Inventor: Brent Adams Ford, Asheville, NC (US)

( * ) Notice: Subject to any disclaimer, the term of this patent is extended or adjusted under 35 U.S.C. 154(b) by 218 days.

(21) Appl. No.: 17/335,742

(22) Filed: Jun. 1, 2021

(65) Prior Publication Data

US 2021/0371049 A1 Dec. 2, 2021

Related U.S. Application Data

(60) Provisional application No. 63/031,673, filed on May 29, 2020.

(51) Int. Cl.

| | |
|---|---|
| ***B63B 1/04*** | (2006.01) |
| ***B63B 5/24*** | (2006.01) |
| ***B63B 45/02*** | (2006.01) |

(52) U.S. Cl.

CPC ..... *B63B 1/047* (2013.01); *B63B 5/24* (2013.01); *B63B 45/02* (2013.01)

(58) Field of Classification Search

CPC .. B63B 1/047; B63B 5/00; B63B 5/24; B63B 22/00; B63B 22/24; B63B 45/02; A45F 5/00; A45F 2200/0583; A47G 23/02; A47G 2200/02; B63C 9/30

USPC .. 441/1, 32, 43, 81, 86, 129, 130, 131, 132, 441/135, 136; 114/61.25, 61.31; 4/489, 4/496; 220/1, 69, 560

See application file for complete search history.

(56) References Cited

U.S. PATENT DOCUMENTS

| | | | | |
|---|---|---|---|---|
| 3,831,206 A * | 8/1974 | Geary | A47G 9/086 5/413 R |
| 4,571,194 A * | 2/1986 | Kiss | A47G 23/0216 441/1 |
| 4,887,716 A * | 12/1989 | Abraham | A47K 3/004 206/139 |
| 6,029,845 A * | 2/2000 | Mueller | B63B 34/565 220/737 |
| 6,616,493 B2 * | 9/2003 | Powell | A47G 23/0216 206/427 |

* cited by examiner

*Primary Examiner* — Daniel V Venne
(74) *Attorney, Agent, or Firm* — John L. Sotomayor

(57) ABSTRACT

The present disclosure provides a flotation device for ensuring that a container held within the device floats upright in water. The device is a ring with an opening to receive and securely accommodate a container. The ring is comprised of an elastic material to accommodate a variety of sizes of beverage containers and containing a plurality of buoyant inserts such that the ring forms a regular polygon shape. The ring further comprises spacers in between the buoyant inserts for ensuring that the buoyant inserts maintain approximately equidistant spacing, and the floatation device holds its regular polygon shape.

20 Claims, 9 Drawing Sheets

Fig. 13
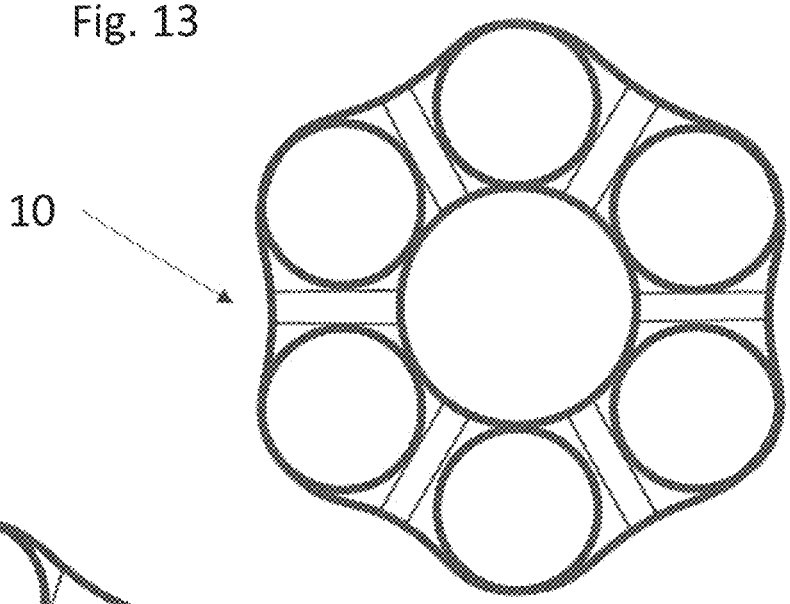
Fig. 14
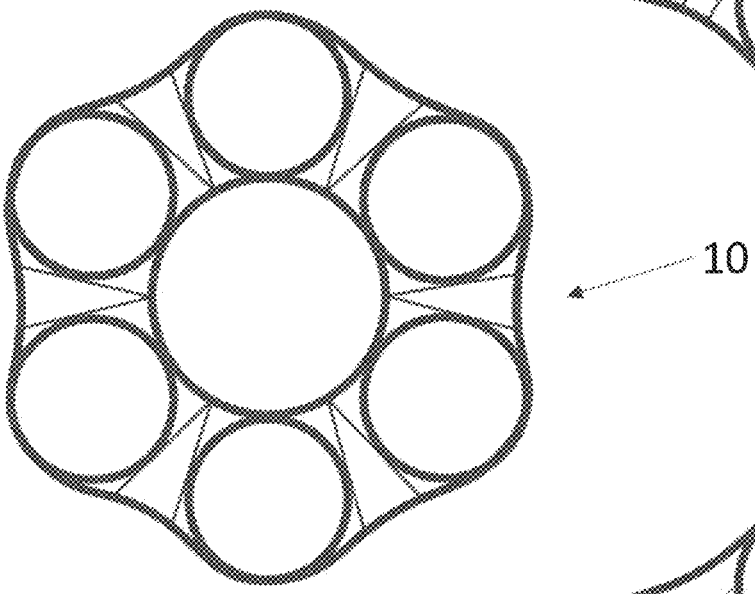
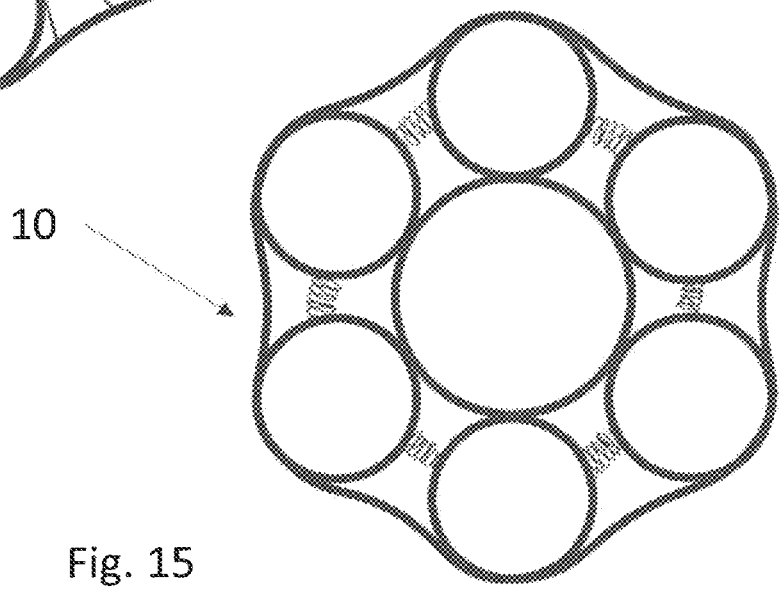
Fig. 15

Fig. 17
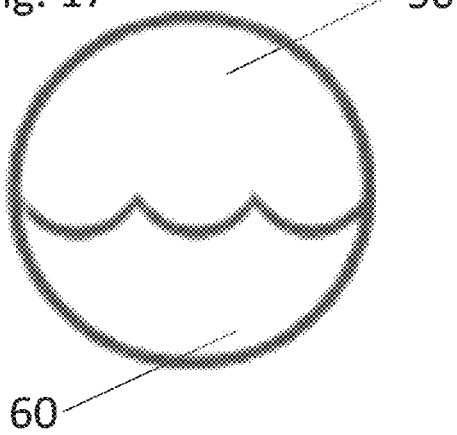
Fig. 18
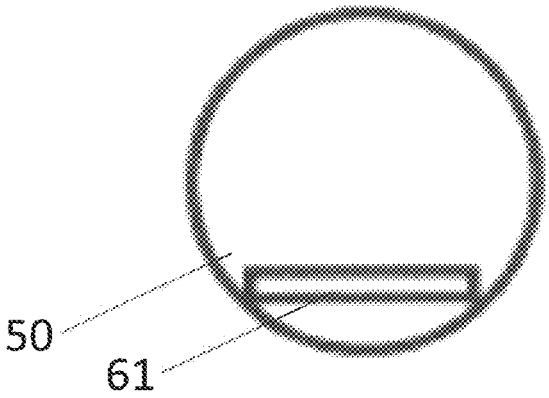
Fig. 19
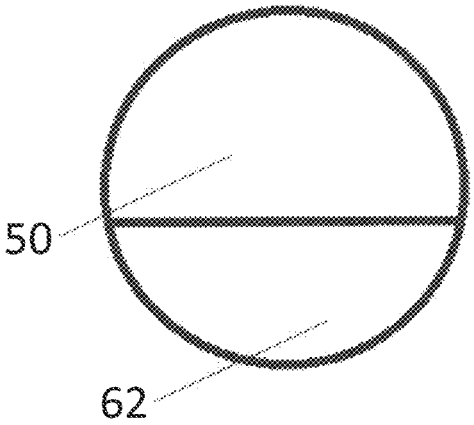
Fig. 20
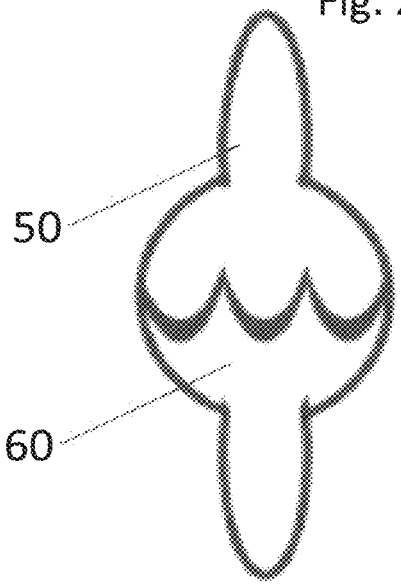
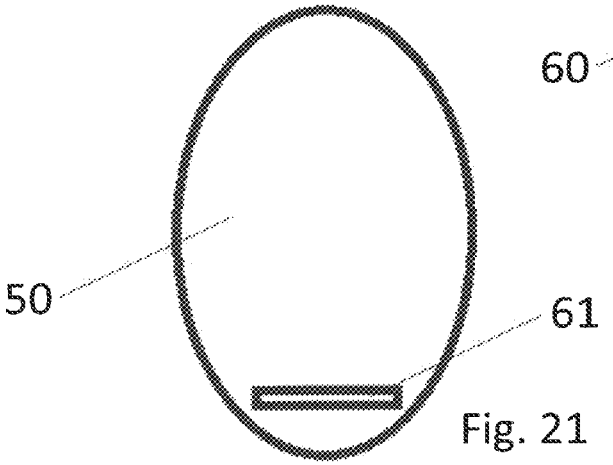
Fig. 21

FLOATATION DEVICE

This disclosure claims the benefit of priority of an earlier filed provisional patent application, namely, U.S. Application No. 63/031,673 filed on May 29, 2020.

FIELD OF THE INVENTION

The field relates to a floatation device for holding a container such that the container floats upright in water.

BACKGROUND

While relaxing in pools, lakes, or other bodies of water, people often enjoy a beverage while within the water. Relaxation dictates that one expends as little mental effort as possible to keep the beverage upright and within reach while swimming, floating, or otherwise enjoying the water. A beverage container incorporating a means for floatation may be used to address this problem.

Over the years, a variety of flotation devices for beverages have been developed and marketed. These devices usually involve a fixed shape that is typically ring-shaped and Incorporate a material with a density less than that of water, for example air, expanded polystyrene, or other materials. The problem with many of these devices is the inability to adjust to a variety of object shapes and sizes, especially when dealing with objects that present with internal buoyancy and centers of gravity that are variable over time. For example, to be supported in water in a stable fashion, a plastic cup full of a beverage has a higher center of gravity and a lower internal buoyancy than that same cup wherein most of the drink has been consumed. Supporting such a container over time requires the flotation device's ability to adjust to those changes in ways to provide optimal support and stability at all times.

Improvements in devices for providing variably buoyant, adjustable, floating support with a high degree of stability in the water would be welcome. Such improvements are detailed in this disclosure.

BRIEF DESCRIPTION OF THE DRAWINGS

Embodiments will be readily understood by the following detailed description in conjunction with the accompanying drawings. To facilitate this description, reference numerals designate like structural elements. Embodiments are illustrated by way of example, and not by way of limitation, in the figures of the accompanying drawings.

FIGS. 11-15 are sectional top views of additional embodiments of floatation devices.

FIGS. 17-21 are sectional side views of embodiments of buoyant inserts for use in a floatation device.

DETAILED DESCRIPTION OF THE DRAWINGS

Figure 2:
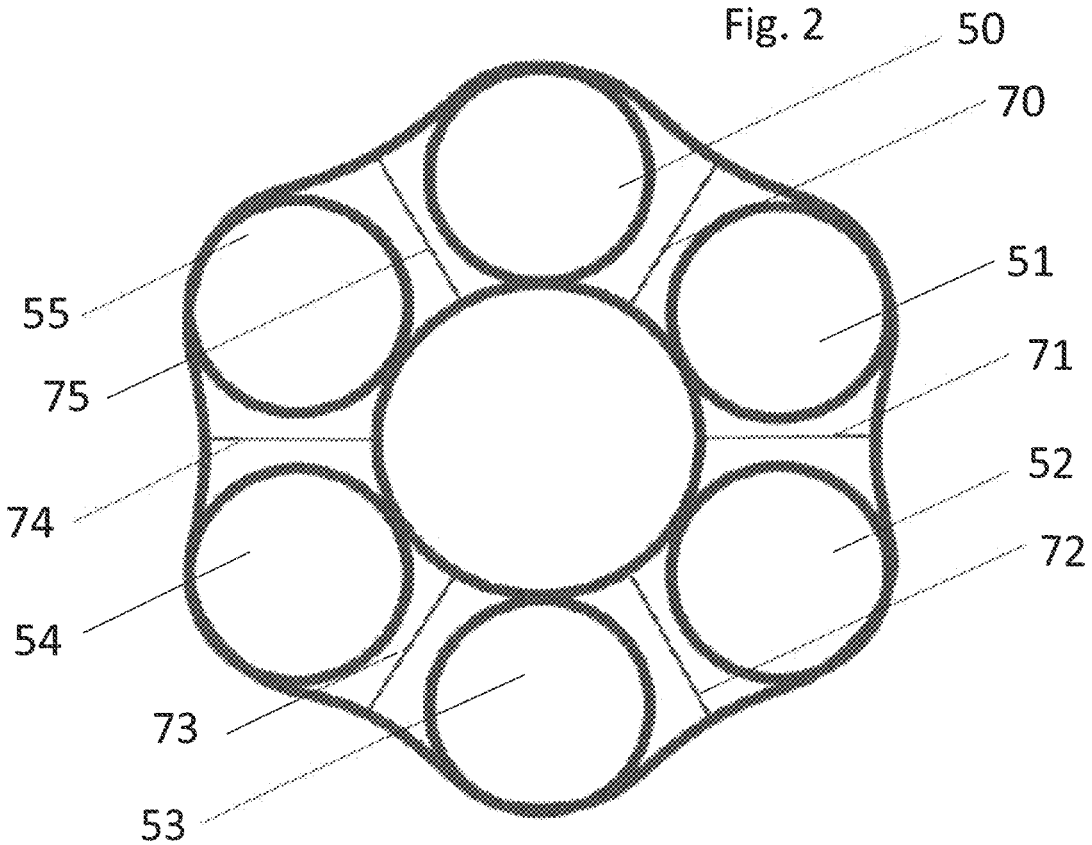
FIG. 2 is a sectional top view of a floatation device.
Figure 3:
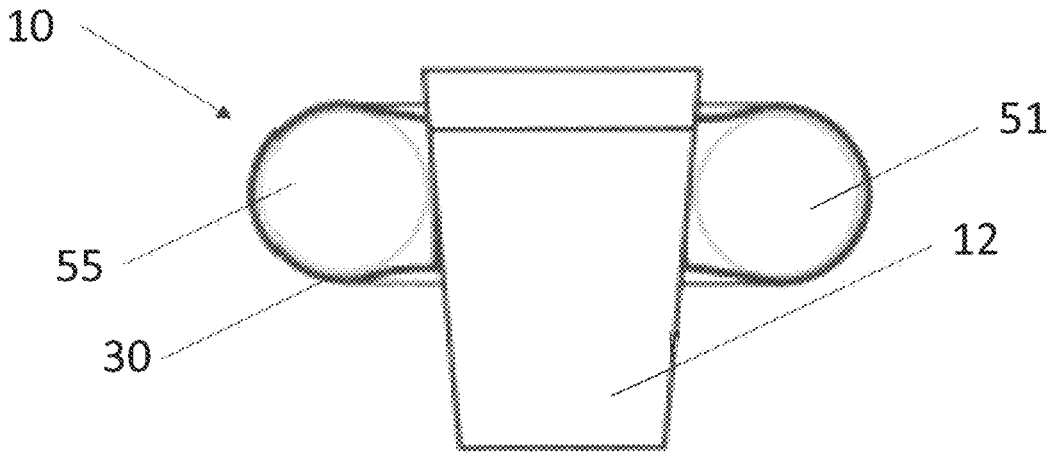
FIGS. 3 and 4 are sectional side views of an embodiment of a beverage floatation device encircling a beverage container.
Figure 4:
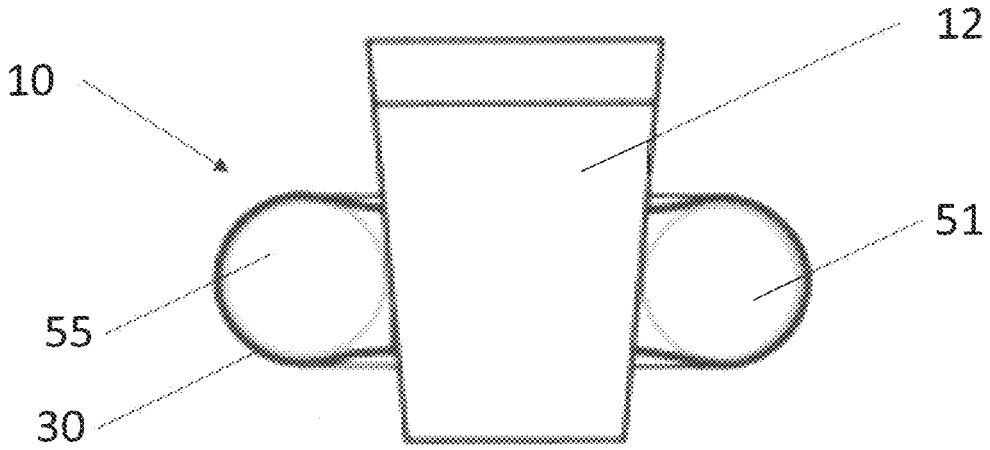
Figure 5:
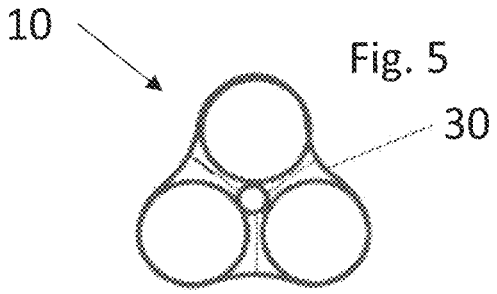
FIGS. 5-10 are sectional top views of additional embodiments of floatation devices.
Figure 6:
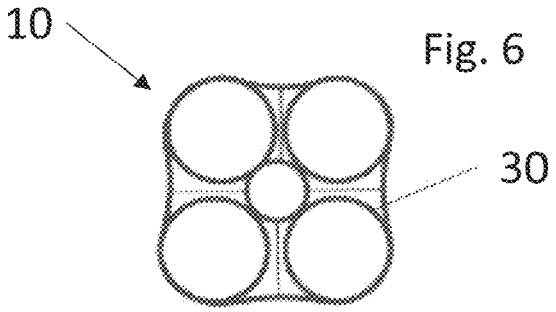
Figure 7:
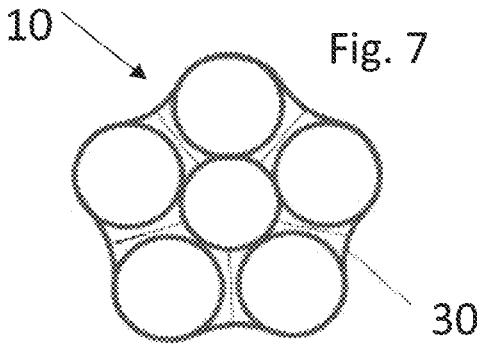
Figure 8:
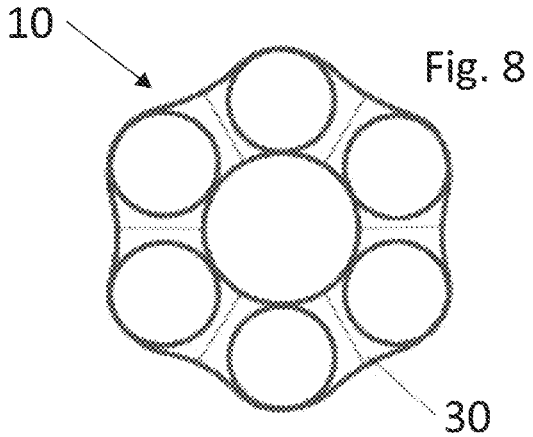
Figure 9:
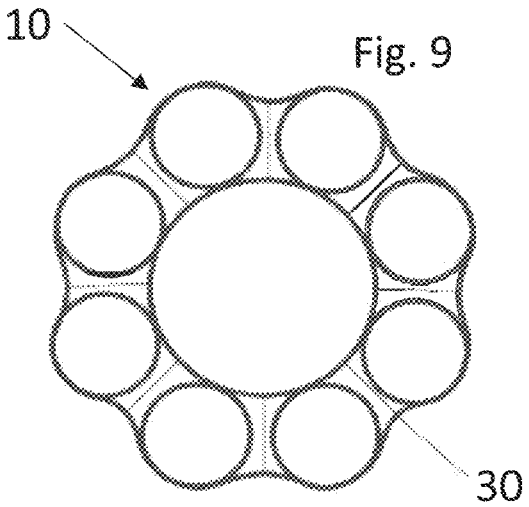
Figure 10:
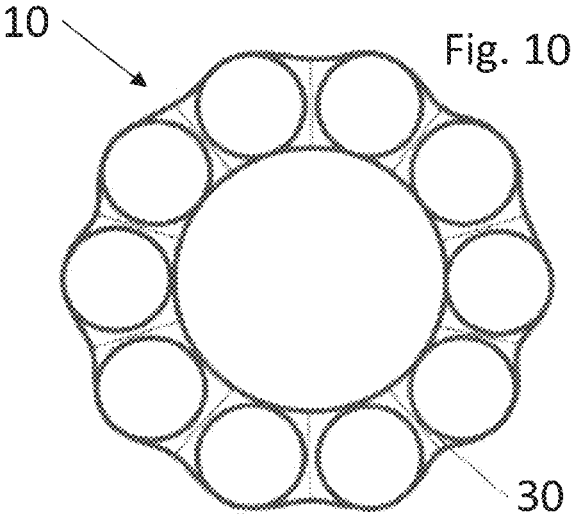
Figure 16:
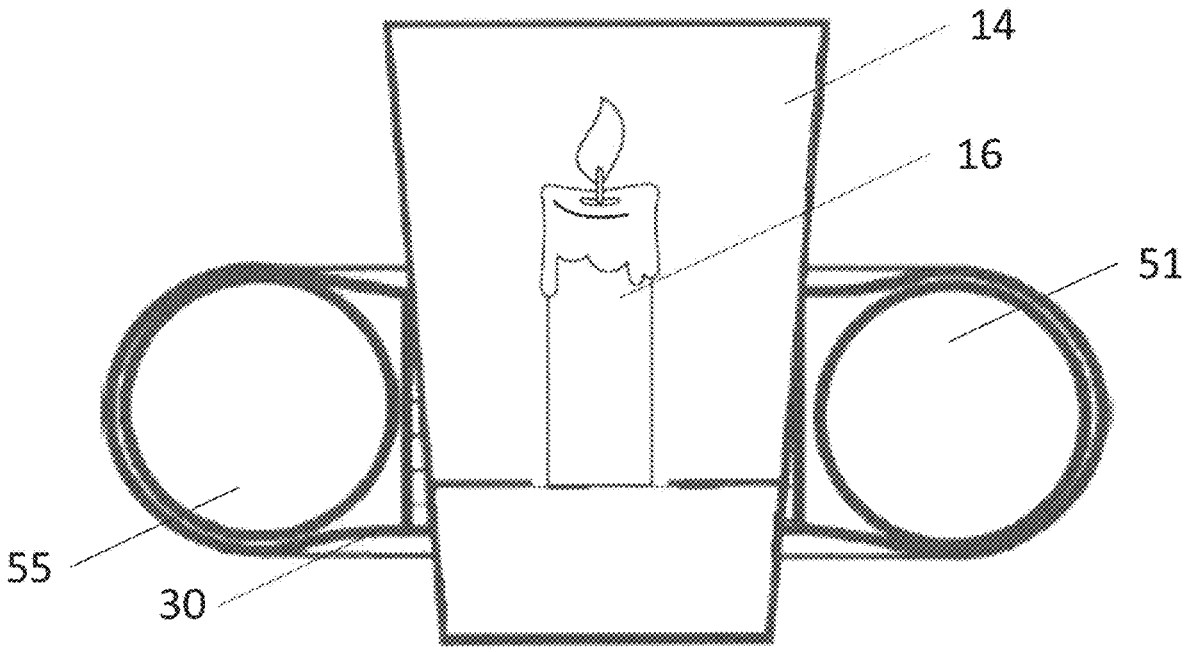
FIG. 16 is a sectional side view of an embodiment of a floatation device encircling a candle within a container.
Figure 22:
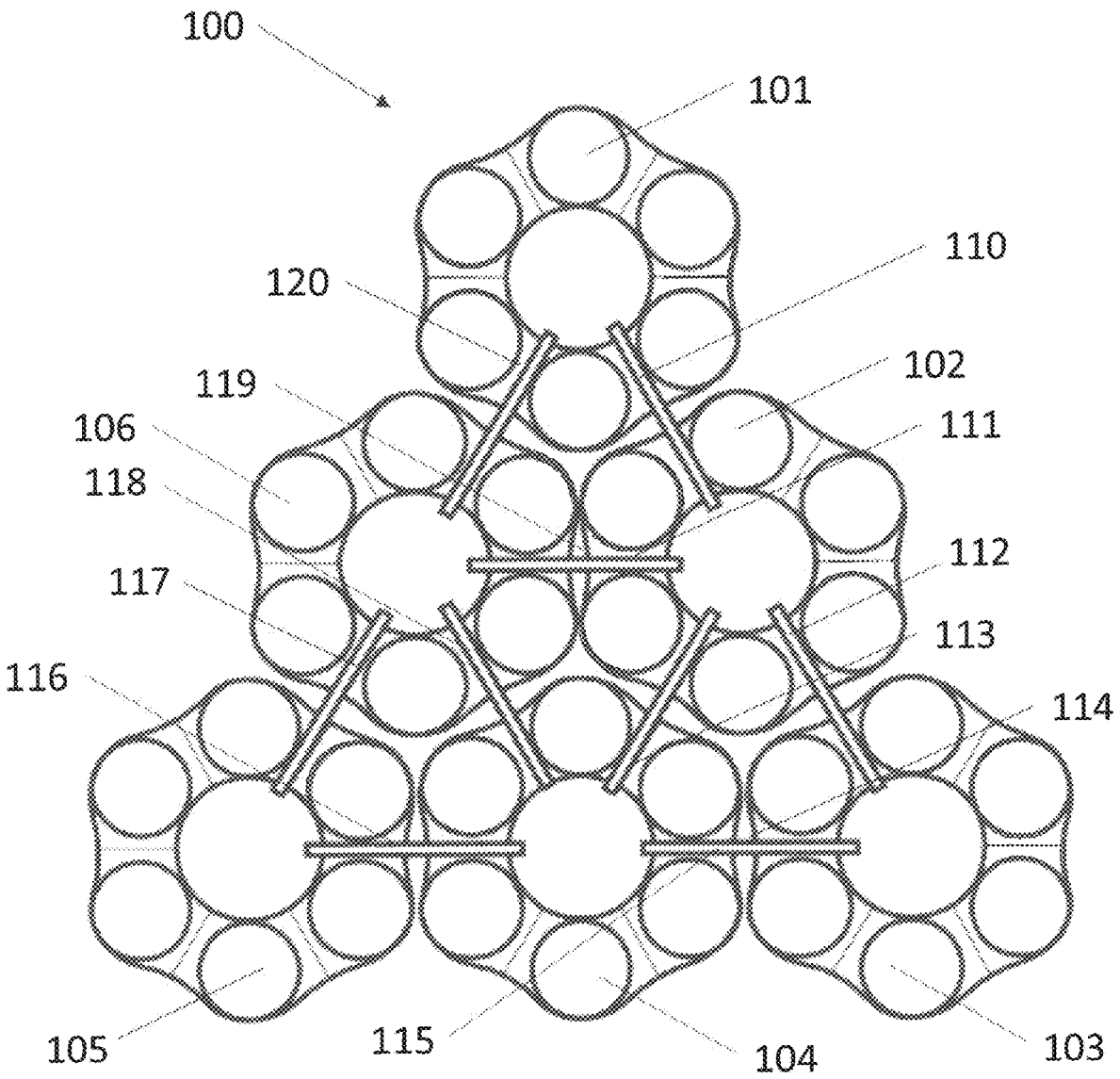
FIG. 22 provides a sectional top view of a game device comprising a plurality of the floatation devices.

FIGS. 1-16 depict various embodiments of a floatation device 10 that may be used to hold a container, depicted here for a beverage in FIGS. 3-4 or a candle in FIG. 16, such that the container floats upright in water. The floatation device 10 is formed such that it may accommodate containers of varying and irregular sizes and will keep such containers upright while floating in water.

Figure 1:
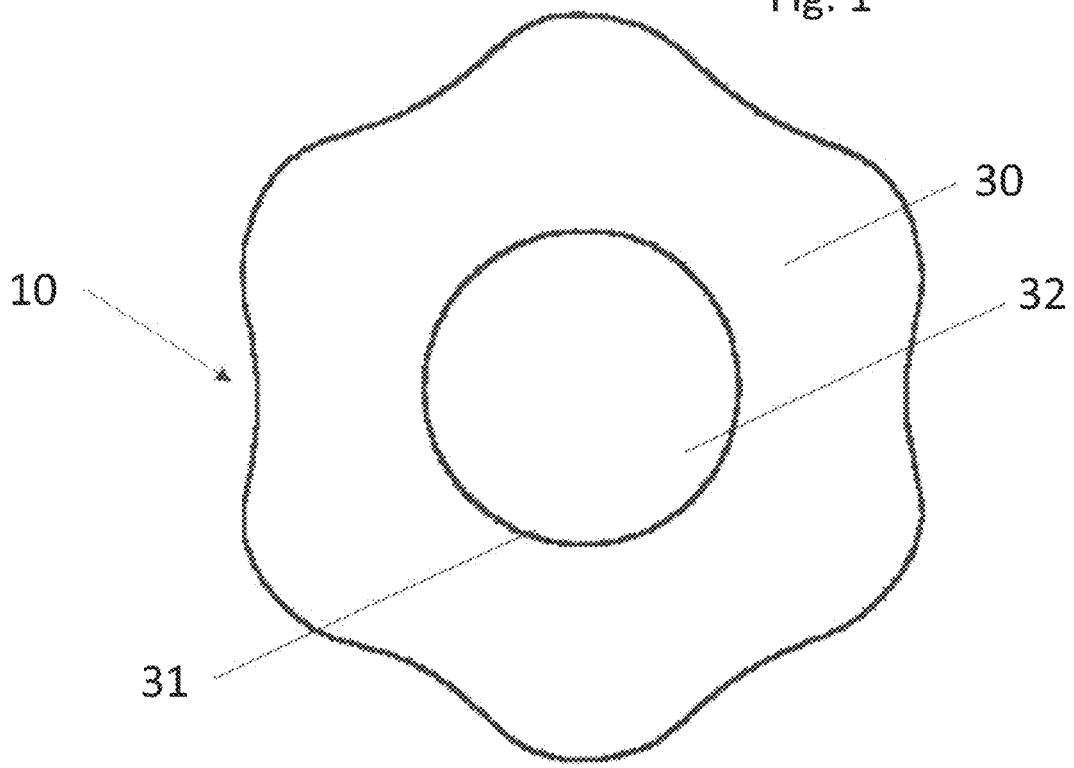
FIG. 1 is a top view of an embodiment of a floatation device.

In one embodiment as shown in FIGS. 1-2, the floatation device 10 is formed by placing buoyant inserts 50, 51, 52, 53, 54, 55 inside an elastic casing 30 and incorporating spacers between each of the buoyant inserts 50, 51, 52, 53, 54, 55. The buoyant inserts 50, 51, 52, 53, 54, 55 as depicted here are hollow plastic spheres such as ping pong balls. Other materials in other shapes, such as are shown in FIGS. 20 and 21, may be substituted to insert within the elastic casing so long as such materials have a density less than that of water and preferably with sufficient rigidity that they will not become deformed by repetitive use. Examples of such materials include substantially plastic shapes, expanded polystyrene shapes, cork shapes, foam shapes, low-density polyethylene shapes, and polypropylene shapes.

It may be desirable for a buoyant insert 50 to incorporate a weight, either as the way in which it is manufactured or, should the buoyant insert 50 have a hollow interior, by incorporating a weight able to freely move within the buoyant insert 50. Incorporation of a weight at or toward the lower portion of the buoyant insert 50 will increase the moment of inertia of the buoyant insert 50, thereby resisting changes in motion resulting from external forces exerted on the buoyant insert 50 and increasing the overall stability of the floatation device 10. For example, FIGS. 17 and 20 depict forms partially filled with water 60, FIGS. 18 and 21 depicts a buoyant insert 50 containing a coin 61, and FIG. 19 shows a buoyant insert 50 partially filled with sand 62.

The elastic casing 30 should be formed from elastic material able to be stretched and then return to its original size. The material ideally should be sufficiently durable to withstand repeated use and exposure to sun and water, shed water, be stain resistant, and able to be easily cleaned. Options for such material include but are not limited to nylon, spandex or elastane, polyester, silicone, some combination thereof, or any other material capable of being formed into a hollow tube and having sufficient elasticity to perform as described herein. The material preferably should be pleasing to the eye and may incorporate a pattern, graphic design, word or phrase, or even a trademark should the device be used as a form of advertising or in the event the manufacturer wishes to include its source identifier on the device.

One of the benefits of the design of the floatation device 10 can be seen in FIGS. 3 and 4. The elastic casing 30 allows an object being supported to be adjusted within the floatation device 10 to provide maximum stability of the object in the water. The elastic casing 30 may stretch to accommodate a variety of shapes and sizes of containers or even to secure a single container in multiple positions. If the floatation device 10 is used to maintain a container 12 in an upright fashion, it is likely that a beverage contained therein will be consumed by the user of the device. As the amount of beverage in the beverage container 12 changes, the center of gravity of the container 12 also changes. Due to the ability of the elastic casing 30 to stretch, the user may slide the floatation device 10 down as the beverage is consumed and the center of gravity shifts to a higher point in the container 12.

It is anticipated that the friction between a container and the aperture 31 of the floatation device 10 would alone be sufficient to hold a container in place. Still, it may be desirable to provide some additional means for increasing friction between the ring and a container. The application of elastomeric material to the aperture 31 of the elastic casing 30 is one such option (not depicted). Other options may include attaching an elastic band to the aperture 31 of the elastic casing 30 wherein such band has less elasticity than the elastic casing or incorporating a section of stretch stitching stitched through the aperture 31 of the elastic casing 30.

FIGS. 5-10 depict several embodiments of a floatation device 10, each having a different number of buoyant inserts to give the elastic casing 30 different regular polygon shapes with the buoyant inserts forming the vertices of the shape. Several shapes in the physical universe offer a greater degree of stability than others. A fixed-ring, circular shape is one such example and for years has formed the basis for many devices, particularly those involving compressed air pushed inside an airtight tube. However, other shapes in nature also exhibit enhanced stability. It is these other shapes, namely, regular polygons, that are utilized in this disclosure. In developing a floatation device, whether it is used to support a beverage, a candle, another lighting element, or something else, the combination of the relative sizes of the equidistant buoyant components, the overall dimensions of the object to be supported, and the ability to make adjustments as to where the supported object's center of gravity is located, may dictate different polygons. A three- or four-sided floatation device 10, containing three or four buoyant inserts, will provide sufficient stability for smaller containers. A greater number of sides, and thus a greater number of buoyant inserts, may be necessary for a floatation device 10 used with larger objects.

The spacers between the buoyant inserts 50, 51, 52, 53, 54, 55 in the floatation device 10 serve to hold the buoyant inserts 50, 51, 52, 53, 54, 55 relatively securely in place and substantially equidistant from one another within the elastic casing 30. In view of the elasticity of the elastic casing 30, one skilled in the art will appreciate that the equidistance spacing will likely be approximate rather than precise. This incorporation of spacers allows for increased stability of the floatation device 10 by maintaining the floatation device 10 in a regular polygon shape with the buoyant inserts 50, 51, 52, 53, 54, 55 serving as the vertices and the aperture 31 being situated at the place of greatest stability, namely, at the incenter of the polygon. There are more than a few methods for accomplishing this.

Stitching may be used as spacers between the buoyant inserts 50, 51, 52, 53, 54, 55, stitched to form a section of reduced elasticity between each of the buoyant inserts As shown in FIG. 2, a plurality of stitched seams 70, 71, 72, 73, 74, 75 are incorporated, one between each of the buoyant inserts 50, 51, 52, 53, 54, 55, creating fully separate chambers within the elastic casing 30 for the buoyant inserts 50, 51, 52, 53, 54, 55. Depending on the material used for the elastic casing 30, there may be other means for creating seams.

Figure 11:
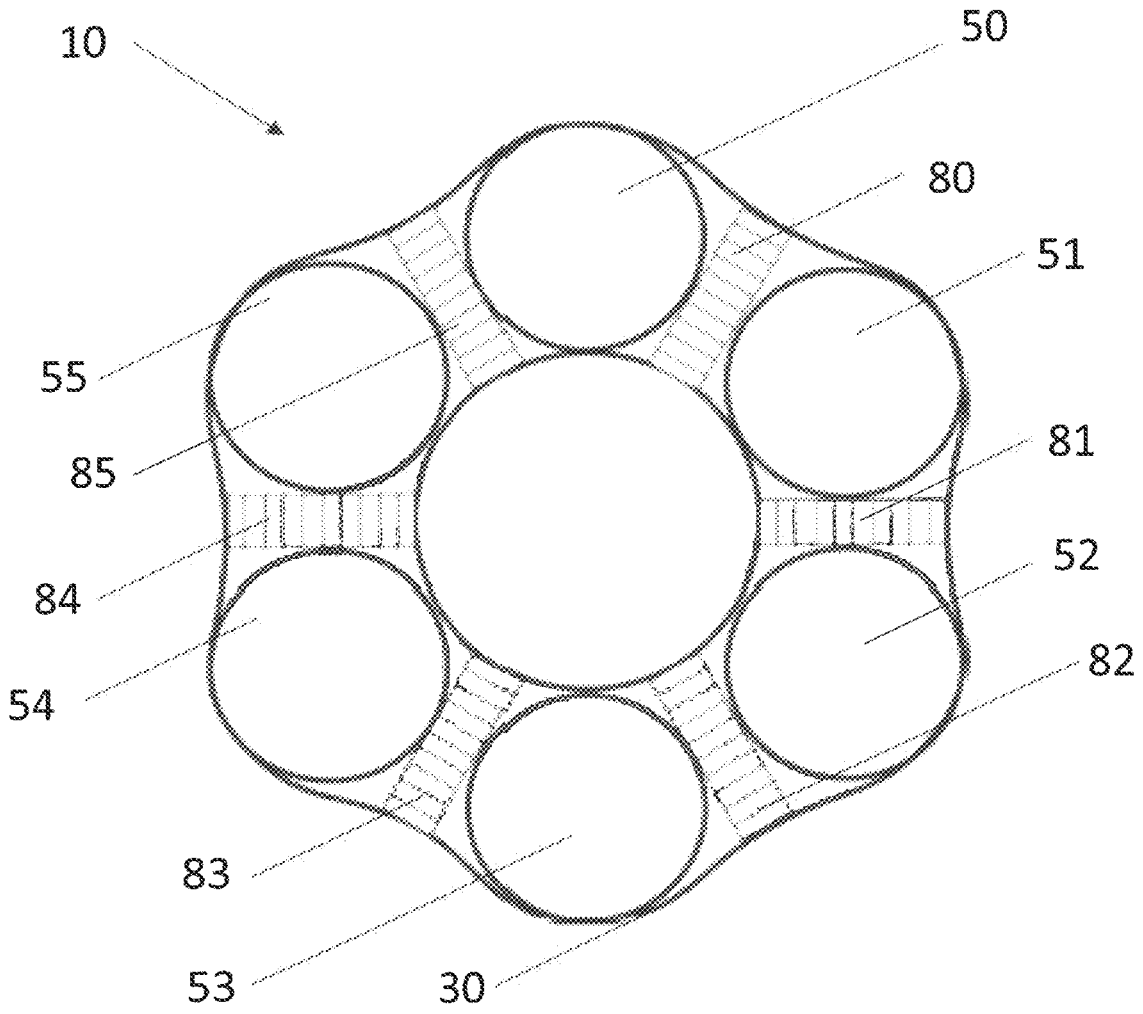

Spacers may also comprise sections of stitches between each of the buoyant inserts 50, 51, 52, 53, 54, 5, each forming a section of reduced elasticity. For example, sections of thread may be stitched in a loop on the elastic casing 30 between each of the buoyant inserts 50, 51, 52, 53, 54, 55. As shown in FIG. 11, another option would be to incorporate a series of drop-stitched thread sections 80, 81, 82, 83, 84, 85, one between each of the buoyant inserts 50, 51, 52, 53, 54, 55, creating separate chambers within the elastic casing 30. Separate chambers for the buoyant inserts 50, 51, 52, 53, 54, 55 within the elastic casing 30 may also be formed by securing pieces of netting between the buoyant inserts 50, 51, 52, 53, 54, 55 (not shown).

Figure 12:
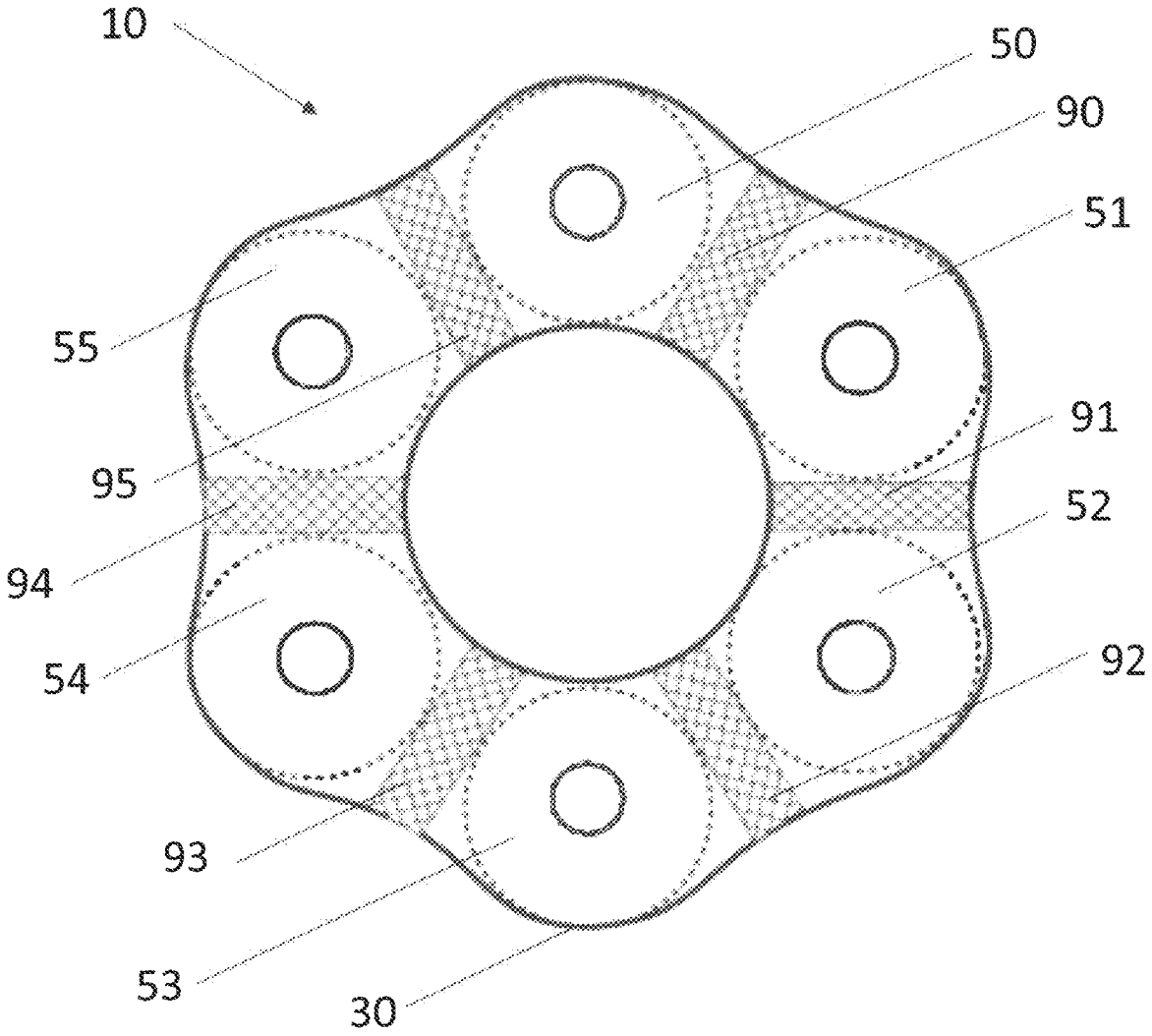

FIG. 12 shows yet another method for separating the buoyant inserts 50, 51, 52, 53, 54, 55. Sections of stitched thread 90, 91, 92, 93, 94, 95 may be stitched onto but not through the elastic casing 30, creating sections of the elastic casing 30 where the materials is compressed such that it is not as pliable as the unstitched sections. There exists a myriad of other options for compressing sections of the elastic casing 30, including but not limited to plastic rings, plastic beads, elastomeric rings, elastomeric beads, or rings of elastic fabric (not shown).

FIGS. 13 and 14 depict embodiments of the floatation device 10 incorporating additional forms within the elastic casing 30 and between the buoyant inserts 50, 51, 52, 53, 54, 55 to serve as spacers. A variety of shapes for spacer inserts would serve the purpose of maintaining the alignment of the buoyant inserts 50, 51, 52, 53, 54, 55—conical buoyant inserts, cylindrical buoyant inserts, or polyhedronal buoyant inserts. Springs are incorporated as spacers within the elastic casing 30 in the embodiment depicted in FIG. 15.

Where there are people who desire to enjoy a beverage while enjoying themselves within a body of water, some may desire to group multiple beverages together so that friends may set their drinks together or a single user may access multiple beverages at once, for example, for a game of beer pong. This calls for a floatation unit 100 capable of keeping a plurality of beverage containers separately accessible as shown in FIG. 21. The embodiment depicted comprises six individual floatation devices 101, 102, 103, 104, 105, 106 held together by a series of connectors 110, 111, 112, 113, 114, 115, 116, 117, 118, 119, 120. The connectors 110, 111, 112, 113, 114, 115, 116, 117, 118, 119, 120 may be zip ties, cords, plastic snap rings, metallic retaining or binder rings, metal opening o-rings, or anything else capable of securely connecting the individual floatation devices 101, 102, 103, 104, 105, 106 into a particular formation and may be more or fewer in number than depicted.

Those skilled in the art will recognize that modifications and adaptions to the above description of illustrated implementations are possible without departing from the intended scope of the disclosure. The specific implementations of the embodiments described herein are provided for illustrative purposes only since various equivalent modifications are possible. Accordingly, the description is not intended to be exhaustive or to limit the scope of the disclosure to the specific forms as disclosed.

The invention claimed is:

1. A floatation device comprising a ring having a regular polygon shape with an aperture sized for holding an object, said ring comprising an elastic casing having an interior and an exterior and capable of expanding to allow for containers of varying and irregular sizes to be inserted within the aperture, a plurality of buoyant inserts held within the interior of the elastic casing and capable of keeping the floatation device afloat in water, and a plurality of spacers between the buoyant inserts for maintaining the buoyant inserts in substantially equidistant positions within the elastic casing.

2. The floatation device of claim 1 wherein the plurality of buoyant inserts are devices selected from a group consisting of plastic shapes, expanded polystyrene shapes, cork shapes, foam shapes, low-density polyethylene shapes, and polypropylene shapes.

3. The floatation device of claim 1 wherein the buoyant inserts are shapes each containing a weight for increasing inertia.

4. The floatation device of claim 1 wherein the spacers are inserted within the interior of the elastic casing between each of the plurality of buoyant inserts and are devices selected from a group consisting of springs, conical buoyant inserts, cylindrical buoyant inserts, or polyhedronal buoyant inserts.

5. The floatation device of claim 1 wherein the spacers are compression means for compressing the exterior of the elastic casing between the buoyant inserts.

6. The floatation device of claim 5 wherein the compression means are devices selected from a group consisting of plastic rings, plastic beads, elastomeric rings, elastomeric beads, and rings of elastic fabric.

7. The floatation device of claim 5 wherein the compression means are sections of thread stitched through the elastic casing between each of the plurality of buoyant inserts to form sections of reduced elasticity and the thread is stitched in a manner selected from a group consisting of loops around the elastic casing, seams stitched through the elastic casing, and drop-stitched barriers stitched through the elastic casing.

8. The floatation device of claim 1 wherein the spacers are netting.

9. The floatation device of claim 1 wherein the aperture further comprises a friction-increasing means within the aperture of the elastic casing for further increasing friction between the ring and a container.

10. The floatation device of claim 9 wherein the friction-increasing means is selected from a group consisting of at least one section of elastomeric material on the exterior of the elastic casing, an elastic band attached to the aperture of the elastic casing and having less elasticity than the elastic casing, and a section of stretch stitching stitched through the elastic casing along the aperture.

11. A floatation device comprising a plurality of rings having a regular polygon shape with an aperture sized for holding an object and a means for connecting the plurality of rings to one another, said plurality of rings each comprising an elastic casing having an interior and an exterior and capable of expanding to allow for containers of varying and irregular sizes to be inserted within the aperture, a plurality of buoyant inserts held within the interior of the elastic casing and capable of keeping the floatation device afloat in water, and a plurality of spacers between the buoyant inserts for maintaining the buoyant inserts in substantially equidistant positions within the elastic casing.

12. A container floatation device comprising an elastic casing formed into a ring-shaped tube capable of expanding to allow for a container to be inserted within an aperture and having an interior and an exterior, a plurality of buoyant inserts capable of keeping the floatation device afloat in water and contained within the interior of the elastic casing, and a plurality of spacers between each of the buoyant inserts for maintaining the plurality of buoyant inserts in substantially equidistant positions within the elastic casing to form a regular polygon shape.

13. The container floatation device of claim 12 wherein the plurality of buoyant inserts are devices selected from a group consisting of plastic shapes, expanded polystyrene shapes, cork shapes, foam shapes, low-density polyethylene shapes, and solid polypropylene shapes.

14. The container floatation device of claim 12 wherein at least one of the plurality of buoyant inserts is a shape containing a weight for increasing inertia.

15. The container floatation device of claim 12 wherein at least one of the plurality of spacers is contained within the interior of the elastic casing, placed between each of the plurality of buoyant inserts, and is a device selected from a group consisting of springs, conical buoyant inserts, cylindrical buoyant inserts, or polyhedronal buoyant inserts.

16. The container floatation device of claim 12 wherein at least one of the plurality of spacers is a compression means for compressing the exterior of the elastic casing between the buoyant inserts.

17. The container floatation device of claim 16 wherein at least one of the compression means is a section of thread stitched through the elastic casing between each of the plurality of buoyant inserts to form sections of reduced elasticity and the thread is stitched in a manner selected from a group consisting of loops around the elastic casing, seams stitched through the elastic casing, and drop-stitched barriers stitched through the elastic casing.

18. The container floatation device of claim 12 wherein at least one of the plurality of spacers is netting.

19. The container floatation device of claim 12 wherein the aperture further comprises a friction-increasing means within the aperture of the elastic casing for further increasing friction between the ring and a container.

20. The container floatation device of claim 19 wherein the friction-increasing means is selected from a group consisting of at least one section of elastomeric material on the exterior of the elastic casing, an elastic band attached to the aperture of the elastic casing and having less elasticity than the elastic casing, and a section of stretch stitching stitched through the elastic casing along the aperture.

* * * * *